US007036446B2

(12) United States Patent
Johns

(10) Patent No.: US 7,036,446 B2
(45) Date of Patent: May 2, 2006

(54) MARINE STEERING ASSEMBLY

(75) Inventor: Ian Johns, Nottinghamshire (GB)

(73) Assignee: Lewmar Limited, Hampshire (GB)

( * ) Notice: Subject to any disclaimer, the term of this patent is extended or adjusted under 35 U.S.C. 154(b) by 0 days.

(21) Appl. No.: 10/868,036

(22) Filed: Jun. 16, 2004

(65) Prior Publication Data

US 2004/0261680 A1 Dec. 30, 2004

(30) Foreign Application Priority Data

Jun. 26, 2003 (GB) ..... 0314898

(51) Int. Cl.
*B63H 25/00* (2006.01)

(52) U.S. Cl. ..... 114/144 R

(58) Field of Classification Search ..... 114/144 R, 114/144 E, 154, 156, 160, 161
See application file for complete search history.

(56) References Cited

U.S. PATENT DOCUMENTS 3,815,537 A * 6/1974 Evans ..... 114/144 R
4,170,953 A * 10/1979 Pounder et al. ..... 114/144 E
4,392,446 A 7/1983 Vander Eyken et al.
4,862,819 A * 9/1989 Fawcett ..... 114/144 R
6,834,606 B1 * 12/2004 Berret et al. ..... 114/144 R

FOREIGN PATENT DOCUMENTS

EP 0 284 417 A1 9/1988

OTHER PUBLICATIONS

"Marine Equipment for Sail and Power Boats", Lewmar catalogue, 2001, pp. 55-110.

* cited by examiner

*Primary Examiner*—Lars A. Olson
(74) *Attorney, Agent, or Firm*—Buchanan Ingersoll PC

(57) ABSTRACT

Disclosed is a marine steering assembly having a steering wheel pedestal, a steering output member, a manual steering mechanism and an auto-pilot drive. The manual steering mechanism is connected to a steering wheel. The manual steering mechanism is retained by the steering wheel pedestal for manual control of the steering output member. The auto-pilot drive is connected to the steering output member and provides automatic control of the steering output member. The auto-pilot drive is aligned with and located adjacent the steering output member. The steering output member, the manual steering mechanism, the pedestal and the auto-pilot drive are accommodated within an outer casing.

19 Claims, 4 Drawing Sheets

MARINE STEERING ASSEMBLY

BACKGROUND TO THE INVENTION

1. Field of the Invention

This invention relates to a marine steering assembly. Of particular, but not exclusive, interest is the installation of an auto-pilot drive in a marine vessel, as well as an installation method.

2. Related Art

At present, marine auto-pilot drives are installed at any available locations within vessels, as long as they can be connected to the associated steering transmissions. However, such locations tend to be fairly inaccessible, with the drives being secured to bulkheads or other components of the vessels, usually below decks, or are even provided with specially installed, custom-made supports in such locations.

SUMMARY OF THE INVENTION

The present inventor has realised that there are several disadvantages associated with these known auto-pilot drive installations. One such disadvantage is that although some locations tend to be inaccessible, they can nevertheless be exposed to undesirable environments and, of course, difficult to access for servicing and maintenance purposes. Another such disadvantage is that they may also obstruct access to other components of the vessel which requires servicing and maintenance and, in certain conditions, may need to be removed temporarily, to permit such access.

It is a preferred object of the invention to overcome, or to reduce or address, at least one of the above-discussed disadvantages associated with known marine auto-pilot drive installations. Preferably, the invention provides a marine auto-pilot drive installation and/or associated marine steering assembly which provide ease of accessibility and which can be installed readily.

Accordingly, in a first preferred aspect, the invention provides a marine steering assembly having a steering wheel pedestal, a steering output member, a manual steering mechanism retained by the steering wheel pedestal for manual control of the steering output member, an auto-pilot drive for automatic control of the steering output member, the auto-pilot drive being located at or adjacent the steering output member and connected or connectable operably thereto.

In this way, the invention may provide a compact and easily installed auto-pilot installation and steering assembly.

Preferably, an outer casing is provided in which the manual steering mechanism and/or the steering output member is at least partially accommodated. The auto-pilot drive may also be accommodated within said outer casing.

The inventor has realised that the innovation of utilising an outer casing to accommodate the auto-pilot drive and at least one of the manual steering mechanism and the steering output member is an important innovation per se.

Accordingly, in a second aspect, the invention provides a marine steering assembly having a steering wheel pedestal, a steering output member, a manual steering mechanism retained by the steering wheel pedestal for manual control of the steering output member, an outer casing in which the manual steering mechanism and/or the steering output member is at least partially accommodated, and an auto-pilot drive for automatic control of the steering output member, the auto-pilot drive being accommodated within said outer casing.

Preferably, the auto-pilot drive is located at or adjacent the steering output member and connected or connectable operably thereto.

Further preferred and/or optional features will now be set out. These are applicable to any aspect of the invention and may be combined in any combination.

Typically, the steering output member extends downwardly along the pedestal from the manual steering mechanism. In use on a vessel, the steering output member is typically linked to steering apparatus (e.g. a rudder) of the vessel via suitable transmission means such as cabling. The steering output member may be, for example, a rotatable shaft.

Preferably, the outer casing at least partially accommodates the pedestal. The outer casing may be formed in a single piece.

Preferably, the outer casing has an outwardly bulged portion in the region of its base in which the auto-pilot drive is accommodated.

Preferably, the auto-pilot drive has a housing that is fixed with respect to the pedestal. Typically, the torque provided by the auto-pilot drive to control the steering output member is relatively high. Thus, it is desirable to ensure that the auto-pilot drive and the steering output member have a firm mechanical relationship. This can be ensured by providing the auto-pilot drive and the pedestal in a fixed relationship.

The relationship between the auto-pilot drive housing and the pedestal may be fixed by a connecting member. The connecting member is typically adapted to fit to the deck of the vessel so as to provide a sturdy support for the pedestal and auto-pilot housing with respect to the vessel.

Typically, the auto-pilot drive is of elongate shape. An elongate axis of the auto-pilot drive may be substantially aligned with an elongate axis of the pedestal. As previously mentioned, the auto-pilot drive is preferably located adjacent the pedestal. In this way, a compact arrangement of the auto-pilot drive and the pedestal can be provided.

Typically, the elongate axis of the auto-pilot drive is substantially aligned with a rotational axis of the steering output member.

Preferably, the auto-pilot drive is connected or connectable operably to the steering output member by gearing. The gearing is typically rotatable by the output of the auto-pilot drive, in order to rotate the steering output member. Most preferably, the gearing includes a quadrant spur gear fixed to the steering output member. This may be a similar arrangement to the manual steering mechanism connecting a steering wheel to the steering output member.

In another aspect, the invention provides a marine auto-pilot drive installation comprising a steering wheel pedestal including a manual steering mechanism, to which a steering wheel is mounted or mountable, an outer casing in which the mechanism is at least partially accommodated and an auto-pilot drive linked to the steering mechanism and accommodated within the outer casing of the pedestal.

The outer casing is preferably shaped to accommodate the auto-pilot drive and, in a preferred embodiment to be described hereinbelow, has an outwardly bulged portion in the region of its base in which the drive is accommodated.

A further aspect of the invention resides in a marine steering assembly comprising a manual steering mechanism including a steering column to which is operably mounted or mountable a steering wheel, and an auto-pilot drive located at or adjacent the steering column and connected or connectable operably thereto.

In conventional manner, the upper end of the steering column is preferably mounted operably to the rotational axis of the steering wheel via a quadrant spur gear or any other suitable gearing. In a similar manner, the auto-pilot drive may be connected or connectable operably to the lower end of the steering column by means of, say, a quadrant spur gear or other suitable gearing rotatable by the output of the auto-pilot drive, in order to rotate the steering column and, hence, the associated rudder of the vessel by suitable cabling or other steering transmission means.

As in the case of the previous aspect of the invention, wherein the auto-pilot drive is accommodated in the outer casing of the steering pedestal, the auto-pilot drive of a corresponding marine steering assembly in accordance with this aspect of the invention may also be accommodated in an outer casing in which the steering column is also accommodated.

A still further aspect of the invention resides in a method of installing a marine auto-pilot drive in a vessel, comprising;

providing a steering wheel pedestal including a manual steering mechanism and an outer casing in which the steering mechanism is at least partially accommodated; and accommodating also a marine auto-pilot device within the outer casing of the-pedestal.

BRIEF DESCRIPTION OF THE DRAWINGS

In order that the invention may be more fully understood, preferred embodiments of marine auto-pilot drive installations and steering assemblies in accordance with the above aspects of the invention, are set out below by way of example and with reference to the accompanying drawings in which.

DESCRIPTION OF THE PREFERRED EMBODIMENTS

Figure 1:
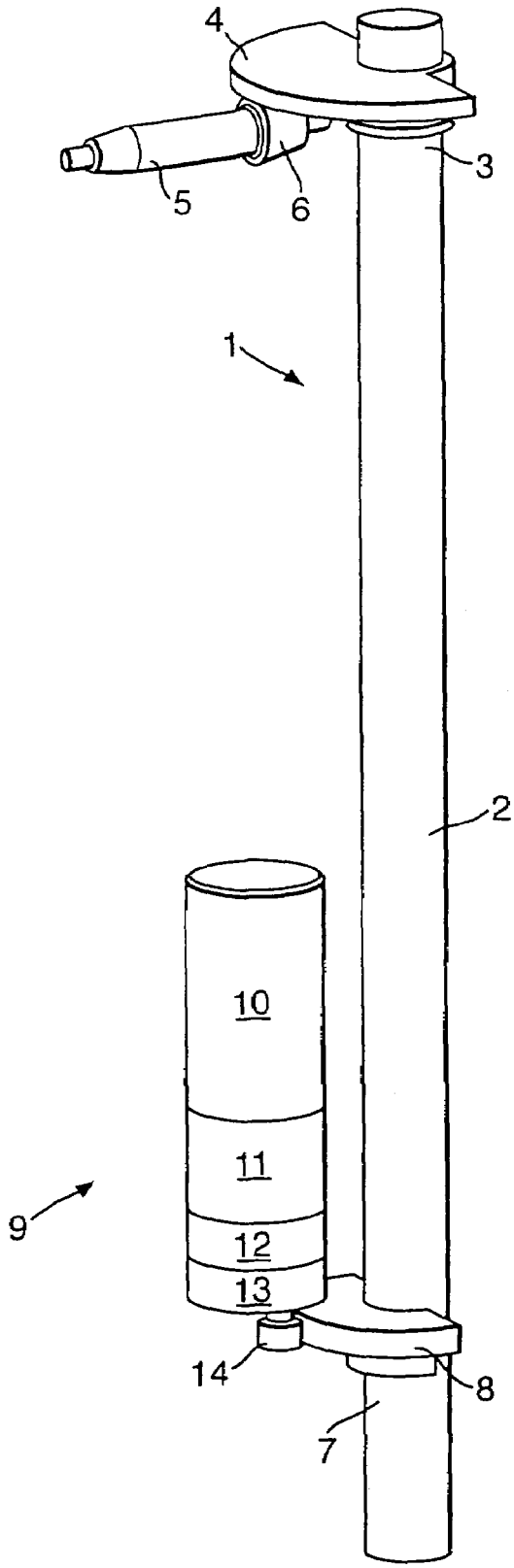
FIG. 1 is a perspective view of the general layout of a marine steering assembly according to an embodiment of the invention.

Referring firstly to FIG. 1 of the accompanying drawings, a marine steering assembly, indicated generally at 1, comprises a manual steering mechanism including a steering column in the form of an upright rotatable shaft 2 at whose upper end 3 is mounted a quadrant spur gear 4 drivable by the rotational axis 5 of a steering wheel (not shown) via a drive spur gear 6.

At the lower end 7 of the shaft 2 is provided another quadrant spur gear 8 which is connected drivably to an auto-pilot drive, indicated generally at 9, comprising a motor 10, primary gear stage 11, clutch 12, final gear stage 13 and an output in the form of a drive spur gear 14 meshing with the lower quadrant spur gear 8.

Thus, the auto-pilot drive 9 is effectively connected operably to the steering column shaft 2 (i.e. the steering output member) in a direct manner.

Figure 2:
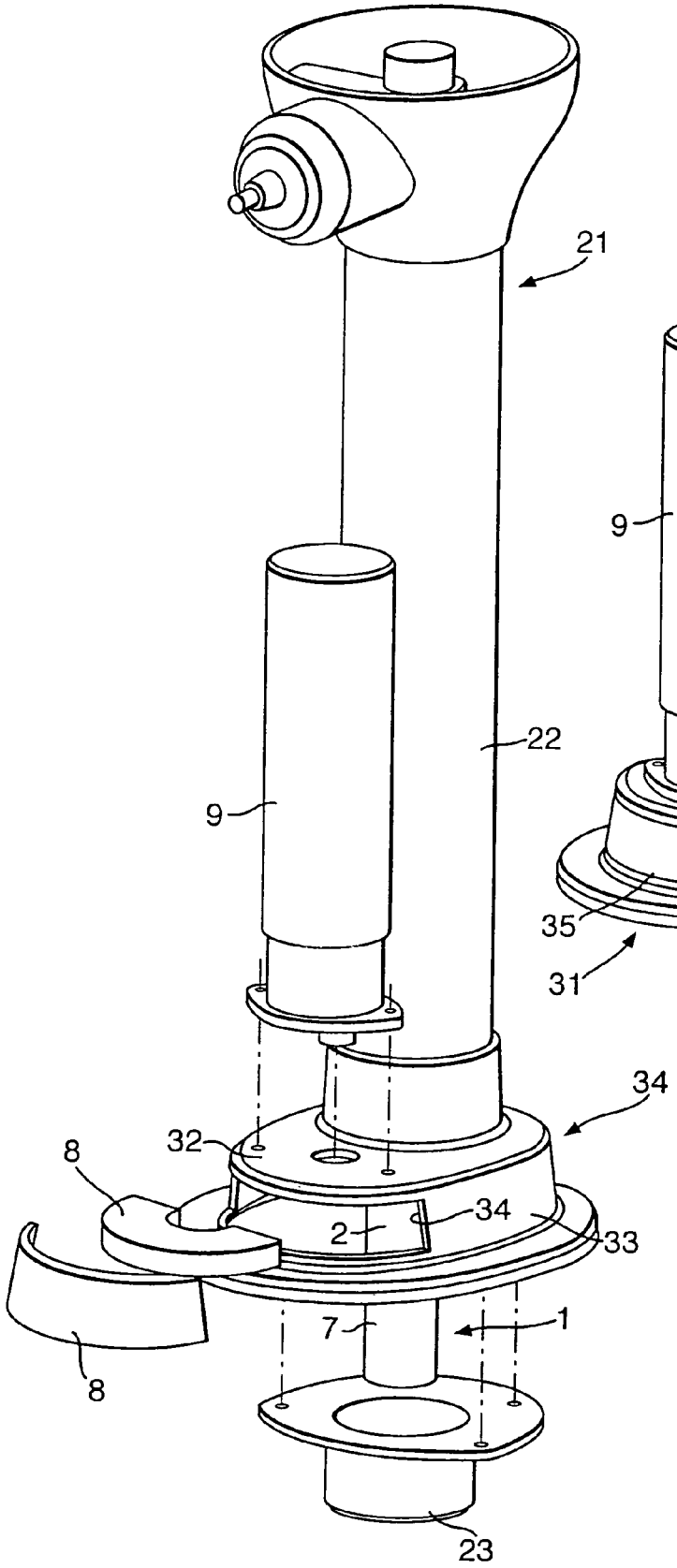
FIG. 2 is a partially-exploded, perspective view of a marine auto-pilot drive installation embodying the assembly of FIG. 1.
Figure 2A:
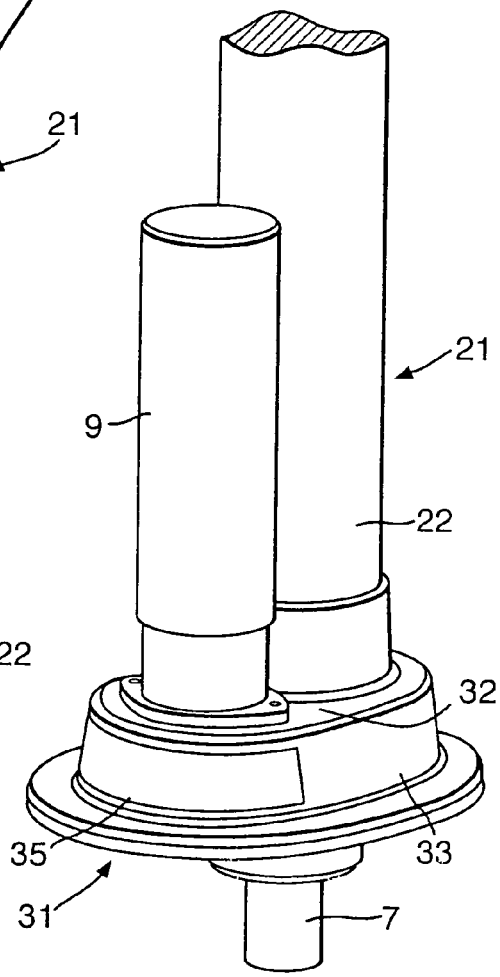
FIG. 2A is a perspective view of the lower end of the installation shown in FIG. 2, in an assembled state.

Referring now to FIGS. 2 and 2A, the marine steering assembly 1 described above in relation to FIG. 1, is incorporated in an auto-pilot drive installation, indicated generally at 21, in which the steering assembly 1 is accommodated within an inner housing 22 (or pedestal), with the auto-pilot drive 9 located in the close vicinity thereof.

The inner housing 22 and auto-pilot drive 9 are mounted upon a base, indicated generally at 31, with the lower end 7 of the steering column shaft 2 extending therethrough into a lower bearing 23.

The base 31 has a raised, generally central portion 32 in whose side wall 33 is provided an aperture 34 through which the quadrant spur gear 8 can be located and secured to the lower end 7 of the steering column shaft 2, whereafter the auto-pilot drive 9 can be connected operably thereto via its output drive spur gear 14. A cover 35 is provided for that aperture 34.

Figure 4:
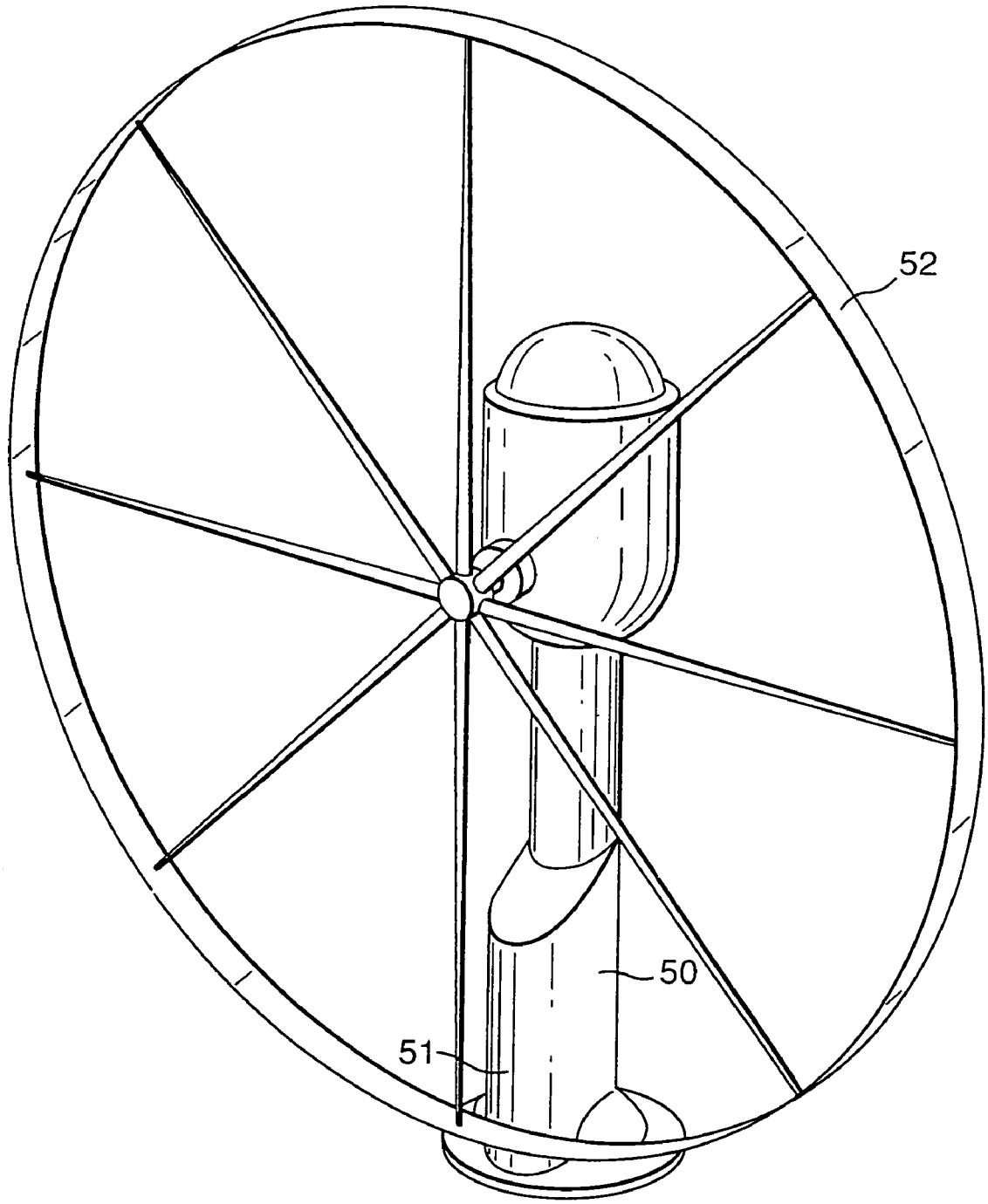
FIG. 4 is a perspective view of a marine auto-pilot drive installation according to an embodiment of the invention, with a steering wheel pedestal and associated steering wheel.

An outer casing 50 can be applied to the installation 21 shown in FIGS. 2 and 2*a*, to provide a steering assembly including a marine auto-pilot drive installation, as shown in FIG. 4.

Figure 3:
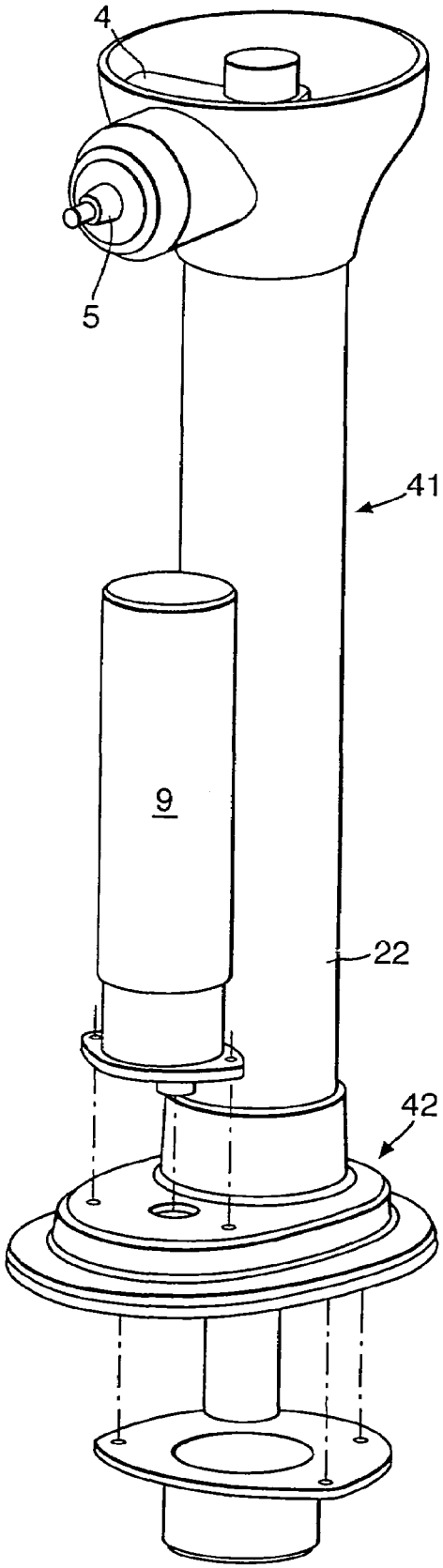
FIG. 3 is a partially-exploded perspective view of a second embodiment of marine auto-pilot drive installation incorporating the assembly shown in FIG. 1.
Figure 3A:
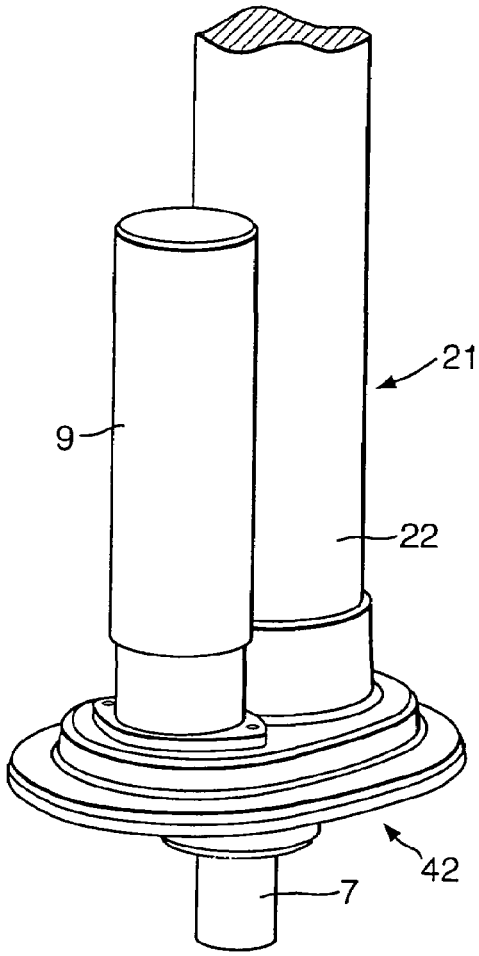
FIG. 3*a* is a perspective view of the lower end of the installation shown in FIG. 3, in an assembled state.

FIGS. 3 and 3A show a similar auto-pilot drive installation 41 to that described above with reference to FIGS. 2 and 2A, except that the base 42 to which the inner housing 22 and auto-pilot drive 9 are mounted already has the quadrant spur gear 8 installed therein, duly attached to the lower end 7 of the steering column shaft 2. Otherwise, the components are the same as those of the installation 21 shown in FIGS. 2 and 2A, with an outer casing 50 providing suitable protection for the components of the installation 21, as shown again in FIG. 4.

The outer casing 50, as shown in FIG. 4, accommodates the auto-pilot drive 9 in a bulged portion 51 thereof at its lower end, as well as accommodating the steering column shaft 2 and associated drive components.

In FIG. 4, a steering wheel 52 is also shown attached to its rotatable axle 5 (rotatable about the longitudinal axis of axle 5), as it is used.

Thus, it can be seen that the invention provides a marine auto-pilot drive installation and associated marine steering assembly which provides ready access, for servicing and maintenance purposes, to the associated marine auto-pilot drive, which is an improvement upon the existing arrangements for installing auto-pilot drives in difficult and generally inaccessible locations within a vessel, and which can also be installed quickly. Further, the outer casing 50 may be contoured, particularly in the region of the auto-pilot device 9, to be aesthetically pleasing to the eye. It will be understood that further embodiments, modifications thereof and modifications of the present embodiments will be apparent to the skilled person on reading this disclosure and these are within the spirit and scope of the present invention.

The invention claimed is:

1. A marine steering assembly comprising:

a steering wheel pedestal;

an upright steering output member;

a manual steering mechanism retained by the steering wheel pedestal for manual control of the steering output member;

an auto-pilot drive for automatic control of the upright steering output member, the auto-pilot drive being located at or adjacent the upright steering output member and connected or connectable directly to the upright steering output member by gearing, the gearing being rotatable by the output of the auto-pilot drive, in order to rotate the upright steering output member; and an outer casing in which the manual steering mechanism or the steering output member is at least partially accommodated, wherein the auto-pilot drive is also accommodated within said outer casing.

2. An assembly according to claim 1 wherein the outer casing at least partially accommodates the pedestal.

3. An assembly according to claim 1 wherein the outer casing is formed in a single piece.

4. An assembly according to claim 1 wherein the outer casing has an outwardly bulged portion in the region of its base in which the auto-pilot drive is accommodated.

5. An assembly according to claim 1 wherein the auto-pilot drive has a housing that is fixed with respect to the pedestal.

6. An assembly according to claim 1 wherein the auto-pilot drive is of elongate shape, the elongate axis of the auto-pilot drive being substantially aligned with an elongate axis of the pedestal, the auto-pilot drive being located adjacent the pedestal.

7. An assembly according to claim 1 wherein the auto-pilot drive is of elongate shape, the elongate axis of the auto-pilot drive being substantially aligned with a rotational axis of the steering output member.

8. An assembly according to claim 1 wherein the gearing includes a quadrant spur gear fixed to the steering output member.

9. An assembly according to claim 1 having an outer casing in which the manual steering mechanism and the steering output member is at least partially accommodated, wherein the auto-pilot drive is also accommodated within said outer casing.

10. An assembly according to claim 1, wherein the gearing comprises a first gear that is statically connected to the auto-pilot drive and a second gear that is statically connected to the upright steering output member, the first and second gear each having teeth for interconnecting and transmitting force to one another.

11. A marine steering assembly comprising:

a steering wheel pedestal;

a steering output member;

a manual steering mechanism retained by the steering wheel pedestal for manual control of the steering output member;

an outer casing in which the manual steering mechanism and/or the steering output member is at least partially accommodated; and an auto-pilot drive for automatic control of the steering output member, the auto-pilot drive being accommodated within said outer casing;

wherein the outer casing has an outwardly bulged portion in the region of its base in which the auto-pilot drive is accommodated.

12. An assembly according to claim 11 wherein the auto-pilot drive is located at or adjacent the steering output member and connected or connectable operably thereto.

13. An assembly according to claim 11 wherein the outer casing at least partially accommodates the pedestal.

14. An assembly according to claim 11 wherein the outer casing is formed in a single piece.

15. An assembly according to claim 11 wherein the auto-pilot drive has a housing that is fixed with respect to the pedestal.

16. An assembly according to claim 11 wherein the auto-pilot drive is of elongate shape, the elongate axis of the auto-pilot drive being substantially aligned with an elongate axis of the pedestal, the auto-pilot drive being located adjacent the pedestal.

17. An assembly according to claim 11 wherein the auto-pilot drive is of elongate shape, the elongate axis of the auto-pilot drive being substantially aligned with a rotational axis of the steering output member.

18. An assembly according to claim 11 wherein the auto-pilot drive is connected or connectable operably to the steering output member by gearing, the gearing being rotatable by the output of the auto-pilot drive, in order to rotate the steering output member.

19. An assembly according to claim 18 wherein the gearing includes a quadrant spur gear fixed to the steering output member.

* * * * *